US008143816B2

(12) United States Patent
Clayton et al.

(10) Patent No.: US 8,143,816 B2
(45) Date of Patent: Mar. 27, 2012

(54) POWER VARIATOR

(75) Inventors: James Clayton, San Jose, CA (US); Carsten Weil, Backnang (DE); Wolfgang Arnold, Groberlach (DE); David Whittum, Sunnyvale, CA (US)

(73) Assignee: Varian Medical Systems Technologies, Inc., Palo Alto, CA (US)

( * ) Notice: Subject to any disclaimer, the term of this patent is extended or adjusted under 35 U.S.C. 154(b) by 726 days.

(21) Appl. No.: 12/191,145

(22) Filed: Aug. 13, 2008

(65) Prior Publication Data

US 2010/0039051 A1 Feb. 18, 2010

(51) Int. Cl.
*H01J 23/00* (2006.01)

(52) U.S. Cl. ..... 315/500; 315/505; 315/39.55; 315/39.51; 315/5.46; 33/1.1; 33/109; 33/121

(58) Field of Classification Search ..... 315/5.46, 315/5.53, 500, 501, 505, 506, 39, 39.51, 315/39.55, 39.65; 333/108, 109, 117, 121, 333/122, 1.1

See application file for complete search history.

(56) References Cited

U.S. PATENT DOCUMENTS

| | | | | |
|---|---|---|---|---|
| 3,617,921 | A * | 11/1971 | Smith | 330/207 R |
| 3,868,602 | A * | 2/1975 | Meddaugh | 333/17.1 |
| 6,836,621 | B1 * | 12/2004 | Bendelli | 398/83 |
| 6,856,105 | B2 * | 2/2005 | Yao et al. | 315/505 |
| 7,432,672 | B2 * | 10/2008 | Meddaugh et al. | 315/505 |
| 7,545,226 | B2 * | 6/2009 | Shinohara | 331/88 |
| 7,786,675 | B2 * | 8/2010 | Yakovlev et al. | 315/5.39 |
| 7,786,823 | B2 * | 8/2010 | Heisen et al. | 333/109 |

* cited by examiner

*Primary Examiner* — Haiss Philogene
(74) *Attorney, Agent, or Firm* — Vista IP Law Group, LLP

(57) ABSTRACT

An apparatus for use in a process to regulate power for a particle accelerator includes a first circulator, a second circulator, a tee coupled between the first and the second circulator, and a tuner coupled to the tee. An apparatus for use in a process to regulate power for a particle accelerator includes a first circulator, a second circulator, a 3-dB coupler coupled between the first and the second circulator, and a tuner coupled to the 3-dB coupler.

40 Claims, 4 Drawing Sheets

POWER VARIATOR

FIELD

This invention relates generally to power variators, and more specifically, to power variators and their components for use with particle accelerators, such as electron accelerators.

BACKGROUND

Standing wave electron beam accelerators have found wide usage in medical accelerators where the high energy electron beam is employed to generate x-rays for therapeutic and diagnostic purposes. In such applications, dosimetric accuracy at the level of 1% or better is highly desirable. Electron beams generated by an electron beam accelerator can also be used directly or indirectly to kill infectious agents and pests, to sterilize objects, to change physical properties of objects, and to perform testing and inspection of objects, such as containers, containers storing radioactive material, and concrete structures.

A critical problem in national security is inspection of cargo containers. Due to the potential consequences of a single container housing a weapon of mass destruction, 100% inspection of containers is highly desirable. Due to the high rate of arrival of such containers, 100% inspection requires rapid imaging of each container, which in turn, requires a high-pulse repetition frequency of 1000 Hz and higher. For such cargo inspection applications, discrimination against dense objects may require use of two energies, a high energy ("HI" mode) and a low energy ("LO" mode). Examples of Hi and LO modes include operation at nominal beam energies of 6 and 3 MV, and at 9 and 6 MV. Comparison of the images obtained in HI and in LO mode permits high-contrast inspection for and detection of dense objects, which may be indicative of a security threat.

Thus, applicant of the subject application recognizes that it may be desirable to have microwave power from a generator that varies between at least two power levels, such that an accelerator can generate charged particle pulses that vary between at least two different energy levels. However, applicant notices the following problems with existing power systems.

Existing power systems may not be able to accomplish stable and reliable pulse-to-pulse variation in output power. Also, existing power generators may not be able to provide generated power such that energy delivered to the accelerators can vary quickly, e.g., on the order of a millisecond, between at least two energy levels. This rapid variation may be desirable in certain ionizing-radiation systems, such as cargo inspection systems, and in certain medical systems, such as those use for treatment and imaging.

While it is possible to operate tubes with large variations in output power from pulse to pulse, there are certain disadvantages. For example, a magnetron based system may not perform stably when the high voltage pulse is changed by a large value from pulse to pulse. Also, a permanent magnet magnetron operated off of the constant load line may result in additional power dissipation in the modulator. Variation of magnetron frequency from pulse to pulse may not be practical due to mechanical limitations of the tuner, or stability issues associated with the magnetron. As a different example, a klystron-based system may not perform stably when the high voltage pulse is varied by a large value from pulse to pulse, particularly if the tube stability requirements favor operation at saturation. Finally, even where the tube is amenable to operation with a pulse-to-pulse variation in high-voltage, stability of the system as a whole may not be adequate for the application.

Further, in existing systems, microwave or radio-frequency (RF) power provided by a power generator to an accelerator may be reflected back to the power generator. In many applications, it is desirable to reduce this reflected power to a low value, thereby providing high isolation of the reflected power from the source. Sometimes, it may be desirable that such reflected power be controlled in phase and amplitude, so that the frequency of the power generator will be "pulled" to the accelerator frequency, resulting in a stable operation of the power generator and the accelerator. This is often the case for non-coaxial magnetrons. If the reflected power is not controlled, the frequency of the power generator will be pulled away from that of the accelerator, resulting in difficulty of getting the power generator to operate stably and reliably at the frequency that is optimal for accelerator's performance.

SUMMARY

In accordance with some embodiments, an apparatus for regulating power for a particle accelerator includes a first circulator having a first port, a second port, and a third port, wherein the first port is configured for coupling to a power source, a tee having a first port, a second port, a third port, and a fourth port, wherein the first port of the tee is coupled to the second port of the first circulator, and the fourth port of the tee is configured for coupling to the particle accelerator, a first short coupled to the second port of the tee, a second short coupled to the third port of the tee, a tuner coupled to the third port of the tee, and a first load coupled to the third port of the first circulator.

In accordance with other embodiments, an apparatus for use in a process to regulate power for a particle accelerator includes a tee having a first port, a second port, a third port, and a fourth port, wherein the first port of the tee is for receiving a power input, and the fourth port of the tee is configured for outputting power, a first short coupled to the second port of the tee, a second short coupled to the third port of the tee, and a tuner coupled to the third port of the tee, wherein the tuner comprises a ferrite material.

In accordance with other embodiments, an apparatus for regulating power for a particle accelerator includes a first circulator having a first port, a second port, and a third port, wherein the first port is configured for coupling to a power source, a 3-dB coupler coupled to the second port of the first circulator, wherein the 3-dB coupler is configured for coupling to the particle accelerator, a first short, a second short, a tuner, and a first load coupled to the third port of the first circulator, wherein the first short, the second short, and the tuner is coupled to the 3-dB coupler.

In accordance with other embodiments, an apparatus for use in a process to regulate power for a particle accelerator includes a first circulator, a second circulator, a tee coupled between the first and the second circulator, and a tuner coupled to the tee.

In accordance with other embodiments, an apparatus for use in a process to regulate power for a particle accelerator includes a first circulator, a second circulator, a 3-dB coupler coupled between the first and the second circulator, and a tuner coupled to the 3-dB coupler.

Other and further aspects and features will be evident from reading the following detailed description of the embodiments, which are intended to illustrate, not limit, the invention.

BRIEF DESCRIPTION OF THE DRAWINGS

The drawings illustrate the design and utility of embodiments, in which similar elements are referred to by common reference numerals. These drawings are not necessarily drawn to scale. In order to better appreciate how the above-recited and other advantages and objects are obtained, a more particular description of the embodiments will be rendered, which are illustrated in the accompanying drawings. These drawings depict only typical embodiments and are not therefore to be considered limiting of its scope.

DESCRIPTION OF THE EMBODIMENTS

Figure 1:
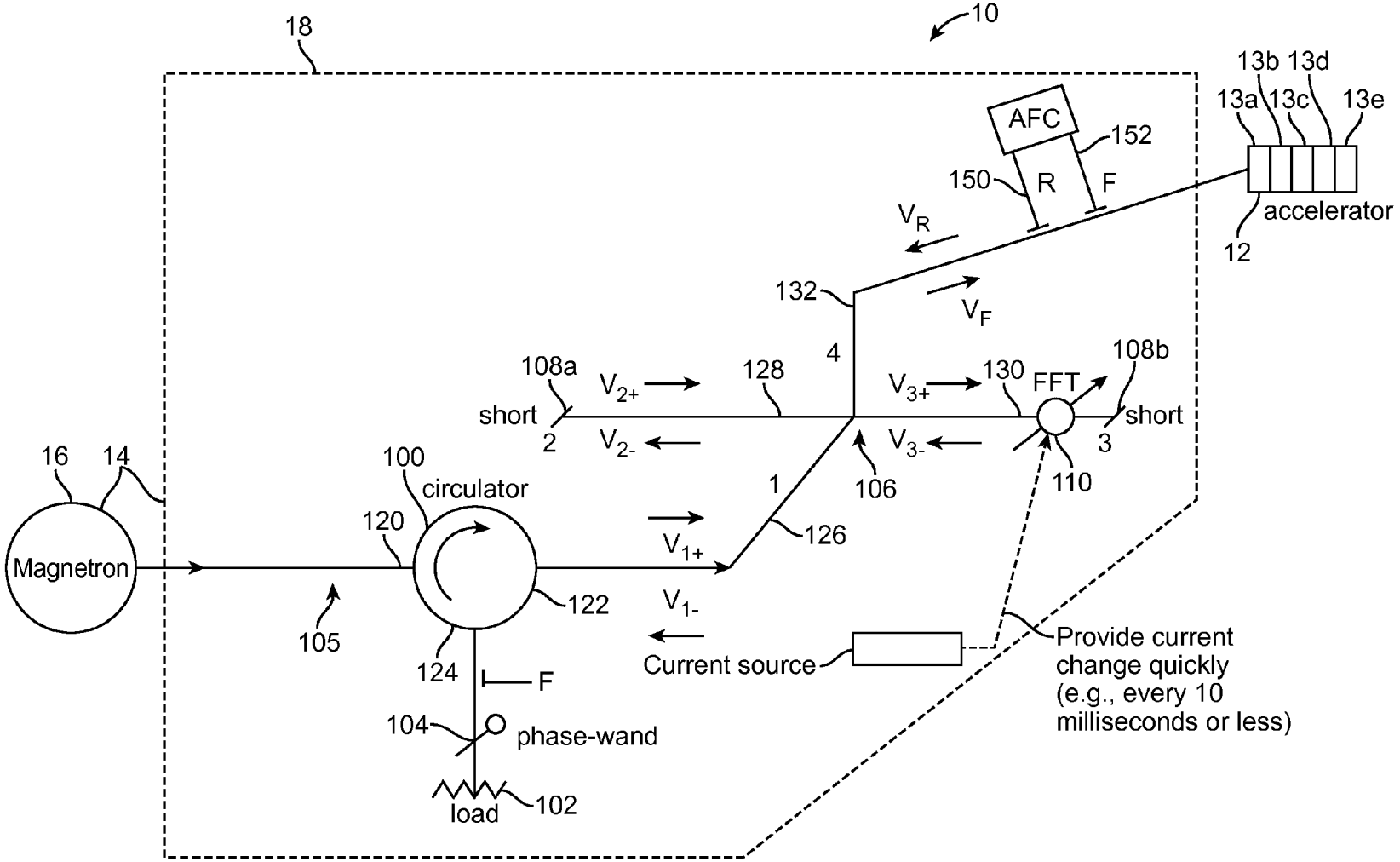
FIG. 1 is a block diagram of a radiation system having an electron accelerator that is coupled to a power generator and a power variator in accordance with some embodiments.

Various embodiments are described hereinafter with reference to the figures. It should be noted that the figures are not drawn to scale and that elements of similar structures or functions are represented by like reference numerals throughout the figures. It should also be noted that the figures are only intended to facilitate the description of the embodiments. They are not intended as an exhaustive description of the invention or as a limitation on the scope of the invention. In addition, an illustrated embodiment needs not have all the aspects or advantages shown. An aspect or an advantage described in conjunction with a particular embodiment is not necessarily limited to that embodiment and can be practiced in any other embodiments even if not so illustrated.

FIG. 1 is a block diagram of a radiation system 10 having an electron accelerator 12 that is coupled to a power system 14, which includes a power generator 16 and a power variator 18 in accordance with some embodiments. The accelerator 12 includes a plurality of axially aligned cavities 13 (electromagnetically coupled resonant cavities). In the figure, five cavities 13*a*-13*e* are shown. However, in other embodiments, the accelerator 12 can include other number of cavities 13. The radiation system 10 also includes a particle source (an electron gun) for injecting particles such as electrons into the accelerator 12. During use, the accelerator 12 is excited by power, e.g., microwave power, delivered by the power system 14 at a frequency, for example, between 0.5 GHz and 35 GHz. Particular examples of the frequency may be 2856 MHz, 3000 MHz, and 9300 MHz. The power generator 16 can be a magnetron (as shown), a klystron, both of which are known in the art, or the like. The power delivered by the power system 14 is in the form of electromagnetic waves. The electrons generated by the particle source are accelerated through the accelerator 12 by oscillations of the electromagnetic waves within the cavities 13 of the accelerator 12, thereby resulting in an electron beam. In some embodiments, the radiation system 10 may further include a computer or processor, which controls an operation of the power system 14.

In the illustrated embodiments, the power variator 18 includes a circulator 100, a load 102, a tee 106, two shorts 108*a* and 108*b*, and a phase-shifter or "tuner" (fast ferrite tuner or FFT) 110. The power variator 18 may optionally include an adjustable element, a ("phase-wand") 104, which may be used to provide stability for the power source's 16 operation when a non-coaxial type power source 16 is used. Example of a phase-wand 104 is described in U.S. Pat. No. 3,714,592 where the phase-wand is referred to as a reflector and variable $\phi$ [phase] shifter. The phase-wand provides a reflection in the waveguide, of controllable phase and amplitude. It may include a mechanical element such as a rod, with a ball on the end seated inside the waveguide, and capable of motion, such as rotation to effect adjustment to the reflection coefficient. Different size balls may be used to vary the reflection amplitude. Placement of the phase wand 104 at the location shown may allow feedback from the accelerator 12 to the power source 16.

The phase-wand 104 may alternatively be located on the output arm 105 of the power source 16. Such configuration allows direct control of the impedance seen by the power source 16. In such cases, the power source's 16 frequency stability is aided by control of the output impedance using the phase-wand 104.

In other embodiments, the phase-wand 104 is not needed, and the power variator 18 does not include the phase-wand 104. For example, the phase-wand 104 may not be needed for a magnetron of the coaxial type.

The circulator 100 is a three port circulator that includes a first port 120, a second port 122, and a third port 124. Alternatively, the circulator 100 may be a four port circulator, or other types of circulator, and can have other number of ports. In other embodiments, the circulator 100 may be an isolator without the phase-wand 104 and the load 102. The first port 120 of the circulator 100 is coupled to the power source 16, the second port 122 of the circulator 100 is coupled to the tee 106, and the third port 124 of the circulator 100 is coupled to the load 102. As used in this specification, the term "couple" refers to connect directly or indirectly. The phase-wand 104 is coupled between the load 102 and the circulator 100. Alternatively it may be located between the magnetron and the circulator 105.

The tee 106 (a "magic-tee" as is known in the art) includes a first arm 126, a second arm 128, a third arm 130, and a fourth arm 132. The magic-tee 106 may be tuned so that it is matched in each of the four arms when matched loads are present on the other three arms, and functions symmetrically with respect to the side-arms 128 and 130. In the illustrated embodiments, each of the arms 126, 128, 130, 132 is a waveguide, for example WR284 at S-Band or WR112 at X-Band, thereby providing a respective port in each of the arms. Coaxial and other forms of waveguide could also be used in other embodiments. Each of the arms 126, 128, 130, 132 may have any length, including a length that is less than a cross-sectional dimension of the arm(s). The first arm 126 is coupled to the second port 122 of the circulator 100, the second arm 128 is coupled to the short 108*a*, the third arm 130 is coupled to the tuner 110, followed by the short 108*b* and the fourth arm 132 of the tee 106 is coupled to the accelerator 12. In other embodiments, the power source 16 may be a part of the power variator 18. Also, in other embodiments, a 3-dB coupler could alternatively be used instead of the magic-tee 106.

It should be noted that FIG. 1 illustrates a schematic diagram of the system 10, and therefore, the actual implementation of the system 10 does not necessarily require the components to be located relatively to each other as that shown in the figure. Thus, in different embodiments of the system 10, the components can be located relative to each other in manners that are different from that shown in FIG. 1. For example, in other embodiments, the transmission line connecting from the tee 106 to the accelerator 12 (while shown as a bent line in the figure) may be any configuration. For example, the transmission line may include bends, rotary joints and other high-power waveguide components that are known in the art.

During use of the system 10, a microwave signal (e.g., in a form of a pulse) is provided from the power source 16. In the illustrated embodiments, the microwave signal is a 3-GHz, 4 us pulse, with 100-1000-Hz pulse repetition frequency, and a peak power of 1-10 MW. In other embodiments, the microwave signal can have other characteristics—i.e., with ranges that are different from those described. In the illustrated embodiments, the waveguide connecting the RF power source 14 and the accelerator 12 may be WR284 (i.e., a rectangular cross section having 2.84" in width×1.34" in height) pressurized with 30 psi of SF6, air or nitrogen. In some cases, Co2 may also be used. In some embodiments, for operation at 9.3 GHz, the pulse might be shorter. Peak power of up to 3 MW could be handled in 45 psi of SF6. In other cases, peak power of up to 5 MW or more may be achieved using vacuum compatible waveguide components.

The signal provided by the power source 16 enters the first port 120 of the circulator 100 and exits the second port 122. The signal is then incident on the tee 106. The signal is then split equally into two parts, one of which travel down the arm 128 to the short 108*a* and the other traversing the arm 130 with the "tuner" 110 (which includes a phase-shifter followed by a short 108*b*). The signal on the third arm 130 is phase-shifted twice as it propagates through the tuner 110.

The two signals, one phase-shifted by the tuner 110 and returning in arm 130, and one returning (without the phase-shift) in arm 128, then meet as they are again incident on the tee junction. The amount of power transmitted out through the arm 132, and the amount of power sent back out through the arm 126 are determined by the amount of the phase-shift on arm 130. In some embodiments, the tuner 110 phase shifts one of the signals so that the two signals are 180-degrees out of phase. In such case, the signals combine constructively at or near the tee junction, and negligible power is transmitted out of arm 126. The full power is then transmitted out of the arm 132 and exits towards the accelerator 12. In other embodiments, the tuner 110 phase shifts one of the signals so that the two signals are in-phase. In this case, the signals combine constructively at or near the tee junction, and enter the first arm 126 to return towards the signal source 16, resulting in no power to the accelerator 12. In further embodiments, the tuner 110 phase shifts one of the signals so that the two signals are not in-phase nor 180-degrees out of phase. In such cases, part of the combined signals travels towards the accelerator 12, while another part of the combined signals travels back towards the circulator 100 via arm 126. Thus, control of the tuner 110 phase shift effects a desired amount of power being transmitted to the accelerator 12.

In some embodiments, the power variator 18 is configured to operate in three modes: HI-mode, LO-mode, and Interleaved-mode. In the Hi-mode, the tuner 110 provides phase shift for allowing maximum power to be delivered to the accelerator 12. In the LO-mode, the tuner 110 provides phase shift for allowing a portion of the full power to be delivered to the accelerator 12. For examples, the tuner 110 may operate to allow 50% (or other values less than 100%) of the full power to be delivered to the accelerator 12. In the Interleaved-mode, the tuner 110 alternates between the HI-mode and the LO-mode. For example, the tuner 110 may operate at 200 Hz to provide 200 Hz of HI-mode power interleaved with 200 Hz of LO-mode power to the accelerator 12. The tuner 110 may operate at other frequencies in other embodiments.

In some embodiments, the power variator 18 may optionally further include a first coupler 150, and a second coupler 152. In such cases, the forward going component of the microwave signal is monitored via the first coupler 150 (e.g., with directivity of 23-27 dB), thereby permitting monitoring of forward going amplitude and frequency. The second coupler 152 may be employed to monitor power (microwave signal) reflected back towards the power source 16. In general, signal reflected from the accelerator 12 contains information on the accelerator 12's resonance frequency. An automatic frequency control (AFC) may use such information to provide a frequency-locking action for the power source 16. Automatic frequency control has been described in U.S. Pat. No. 3,820,035, the entire disclosure of which is expressly incorporated by reference herein. In the afore-mentioned method of AFC, a microwave circuit accepts a reflected ("R") signal, and a forward ("F") signal, and provides as output an analog of phase of the R-signal relative to the F-signal. With a suitable fixed phase adjustment to provide zero-output at the desired operating point (for example, on-resonance), the AFC output signal can be employed in a feedback loop to the rf-source frequency control. Thus this system can serve to remain locked on a desired accelerator operating point, even while the accelerator structure undergoes frequency excursions, e.g., due to thermal effects.

In some embodiments, when operating in the Interleaved-mode, the control system (e.g., which may be a circuit or a computer for controlling the power variator 18) uses only the HI-mode AFC signal to feedback to the power source 16 via the AFC's circuit. For example, the control system may calculate an average of the HI-mode AFC signals within a certain window, and provide the average value as a feedback to the power source 16. This has the effect of locking the power source 16 to the frequency for desired Hi-mode characteristics of the accelerator 12. In other embodiments, the control system can use other LO-mode signals, or a combination of HI-mode and LO-mode signals, for providing feedback to the power source 16.

The power variator 18 may further include a detector-circuit that interlocks and trips the power source 16 in the event of a large reflected signal, so as to prevent damage to the power source 16. The detector may be a microwave detector (e.g., a diode) monitoring the reflected signal (R-signal), or it may be a visible arc detector (e.g., a photodiode, with a viewing port), or it may be an audio detector (e.g., a microphone).

In some cases, the signal derived from the coupler 123 is employed during AFC setup to observe the power level reflected from the accelerator 12, to insure that the frequency of the drive is proximate to the accelerator's 12 resonance. Alternatively, a signal derived from coupler 150 may be used for the same purpose. Thereafter power to the load is monitored by the control system to insure that the AFC circuit is performing correctly to maintain the frequency at the desired value.

In the illustrated embodiments, the tuner 110 may be implemented as a fast ferrite tuner ("FFT"). In the fast ferrite tuner 110, the phase shift is obtained by providing a current-controlled magnetic field permeating a ferrite body within arm 130. The permeability tensor of the ferrite medium is a function of the magnetic field, and consequently the phase-shift in transit through the ferrite body is a function of the current controlling the magnetic field. In some cases, the effect of the FFT 110 can be observed using another coupler (not shown) just before the signal is transmitted to the accelerator 12, and a processor or a computer can be used to transmit command to operate the tuner 110 and/or the power source 16 using this monitoring.

In the illustrated embodiments, the FFT 110 is a transmission line partially filled with ferrite material, which is biased magnetically, e.g., using an electromagnet. In such cases, phase control (e.g., microwave phase control) can be accomplished by changing a current (from a current source) to vary the magnetic field, thereby temporarily altering a characteristic (e.g., permeability) of the ferrite material. Embodiments of the power variator 18 may further include such current source. Such configuration is advantageous in that it allows a relative phase be adjusted quickly, e.g., by changing a current, and therefore the magnetic level and the corresponding RF phase-shift, within a few milliseconds. For example, in some embodiments, the current may be changed at every 10 milliseconds or less, and more preferably, at every 2 milliseconds or less. In some cases, the above configuration allows each pulse to be of a different amplitude at a pulse-repetition-rate (prr) of over 300 pulses-per-second (pps).

In other embodiments, the tuner 110 may be implemented electrically (i.e., to provide phase control using a current) using other devices known in the art. Also, in other embodiments, the tuner 110 may be implemented using a mechanically-sliding short circuit. In further embodiments, the tuner 110 can be implemented as other forms of a delay line. Examples of tuner 110 or its related components that may be used with embodiments described herein are available from AFT Microwave GmbH in Germany.

In some cases, power from the tee 106 (which may be signal from combining signals from arms 128, 130, signal reflected from the accelerator 12, or combination of both), travels to the circulator 100 via arm 126. The power then exits port 124 of the circulator 100 and travels towards load 102. The load 102 is configured to dissipate some or all of the power. The phase-wand 104 may be used to allow part of the power to be transmitted back towards the power source 16, in which case, some of the power exiting port 124 is absorbed in the load 102. Use of a phase-wand has been described in U.S. Pat. No. 3,714,592 ("Network for pulling a microwave generator to the frequency of its resonant load", H. R. Jory), the entire disclosure of which is expressly incorporated by reference herein. Alternatively, the phase-wand 104 may be used to allow all of the power to be transmitted back to the power source 16, in which case, the load 102 absorbs none of the power transmitted back from the tee 106. In some cases, the power transmitted back towards the power source 16 may be used to provide a feedback function. For example, the AFC may use the power transmitted thereto to control the power source 16, thereby stabilizing the frequency of the system 10.

The components 16, 100, 102, 106, 108*a*, 108*b*, 110, 12 can be coupled to each other using one of a variety of devices known in the art. For example, in some embodiments, the components discussed herein may be configured (e.g., sized and shaped) to couple to each other using tube(s), waveguide (s), coaxial line(s), stripline(s), microstrip(s), and combination thereof, all of which are well known in the art. Also, in other embodiments, any of the components may be configured (e.g., sized and shaped) to directly connect to another one of the components.

As shown in the above embodiments, the power variator 18 is advantageous in that it provides the user the ability to change accelerator energies on a pulse by pulse basis. This allows the user to collect more information about the atomic number constituents of the material under examination by the X-rays. With current systems the object would need to be examined twice at each energy separately. Then images or information would have to be combined or fused to show the composite feature. This takes more time and leads to errors in registration. The embodiments of the power variator described herein address these problems. It allows all of the necessary data to be collected in one scan of the object.

Figure 2:
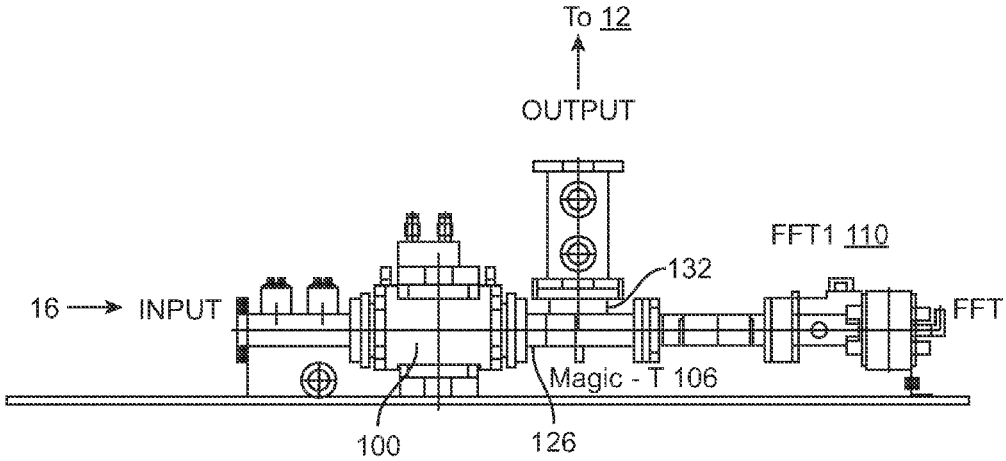
FIG. 2 illustrates an implementation of the power regulator of FIG. 1 in accordance with some embodiments.
Figure 2:
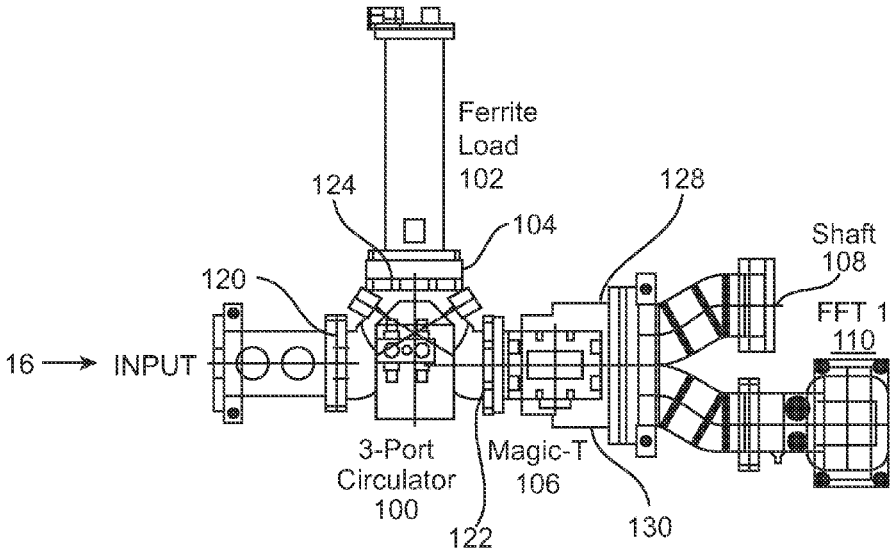

FIG. 2 illustrates an implementation of the power variator 18 of FIG. 1 in accordance with some embodiments. As shown in the figurer the power variator 18 includes a circulator 100, a load 102, a phase-wand 104, a tee 106, a short 108*a*, and a tuner 110 with a short 108*b*. The circulator 100 is a three port circulator that includes a first port 120, a second port 122, and a third port 124. The first port 120 of the circulator 100 is coupled to the power source 16, the second port 122 of the circulator 100 is coupled to the tee 106, and the third port 124 of the circulator 100 is coupled to the load 102. The phase-wand 104 is coupled between the load 102 and the circulator 100. The tee 106 (or "magic-T") includes a first arm 126, a second arm 128, a third arm 130, and a fourth arm 132. The first arm 126 is coupled to the second port 122 of the circulator 100, the second arm 128 is coupled to the short 108*a*, the third arm 130 is coupled to the tuner 110 and short 108*b* via a H-bend, and the fourth arm 132 of the tee 106 is coupled to the accelerator 12.

In certain situations, when the FFT 110 is actuated to reduce the transmitted power (the LO-mode FFT setting), there could be a mismatch of the microwave signal looking back into the port associated with arm 132. The result of this mismatch in the implementation of FIG. 1 is a standing-wave on the arm 132 that connects to the accelerator 12. This standing-wave feature affects power delivered to the accelerator 12 in amount depending on the accelerator's 12 reflection coefficient, the phase-setting, and the line phase-length. In some embodiments, this mismatch may be addressed by the implementation depicted schematically in FIG. 3 and FIG. 4, which illustrate two variations of the power variator 18 in accordance with other embodiments.

Figure 3:
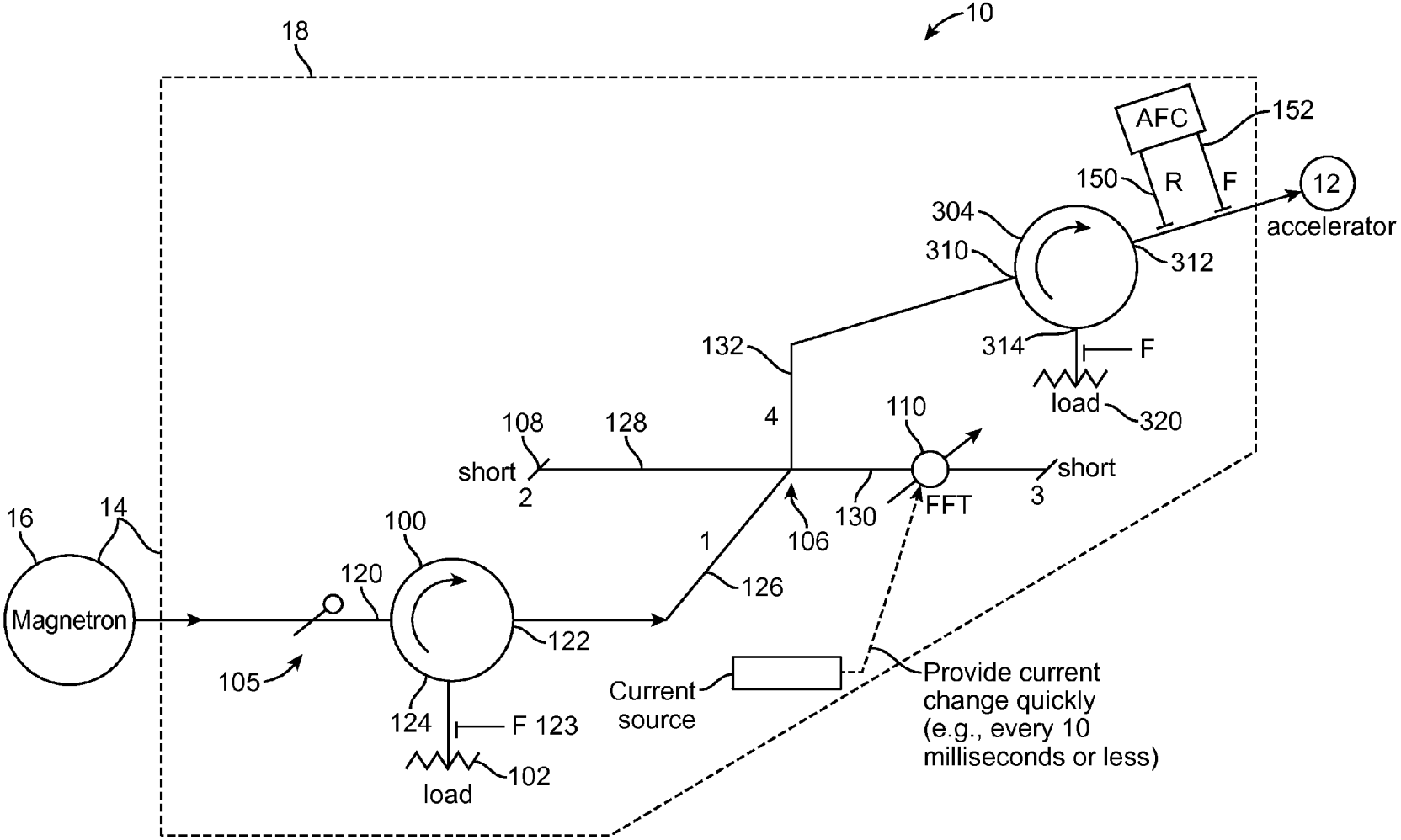
FIG. 3 illustrates a block diagram showing a variation of the power variator of FIG. 1 in accordance with other embodiments.

In FIG. 3, the power variator 18 is similar to that shown in FIG. 1, except that the fourth arm 132 of the tee 106 is coupled to the accelerator 12 through a second circulator 304. The second circulator 304 includes a first port 310, a second port 312, and a third port 314. The second circulator 304 is coupled to the tee 106 via the first port 310, and is coupled to the accelerator 12 via the second port 312. The third port 314 of the second circulator 304 is coupled to a load 320. Use of the second circulator 304 eliminates the standing-wave on the line and provides improved isolation of the system components. It does at the cost of additional insertion loss, typically in the range of 0.15-0.4 dB.

When the circulator 304 is employed, the power then enters the first port 310 of the second circulator 304, and travels to the second port 312. The power leaves the second port 312, and travels to the accelerator 12. In some cases, power may be reflected back from the accelerator 12 and travels towards the second circulator 304. The reflected power enters the second port 312, and travels to the third port 314. The reflected power exits the third port 314 of the circulator 304 and travels towards load 320. The load 320 is configured to dissipate some or all of the power.

Thus, the second circulator 304 may prevent RF power from being reflected back in to the magic-tee 106. In the illustrated embodiments, the second circulator 304 inhibits formation of a standing-wave on the line connecting from port 312 to the accelerator 12. This configuration also has the benefit of simplifying AFC operation.

Figure 4:
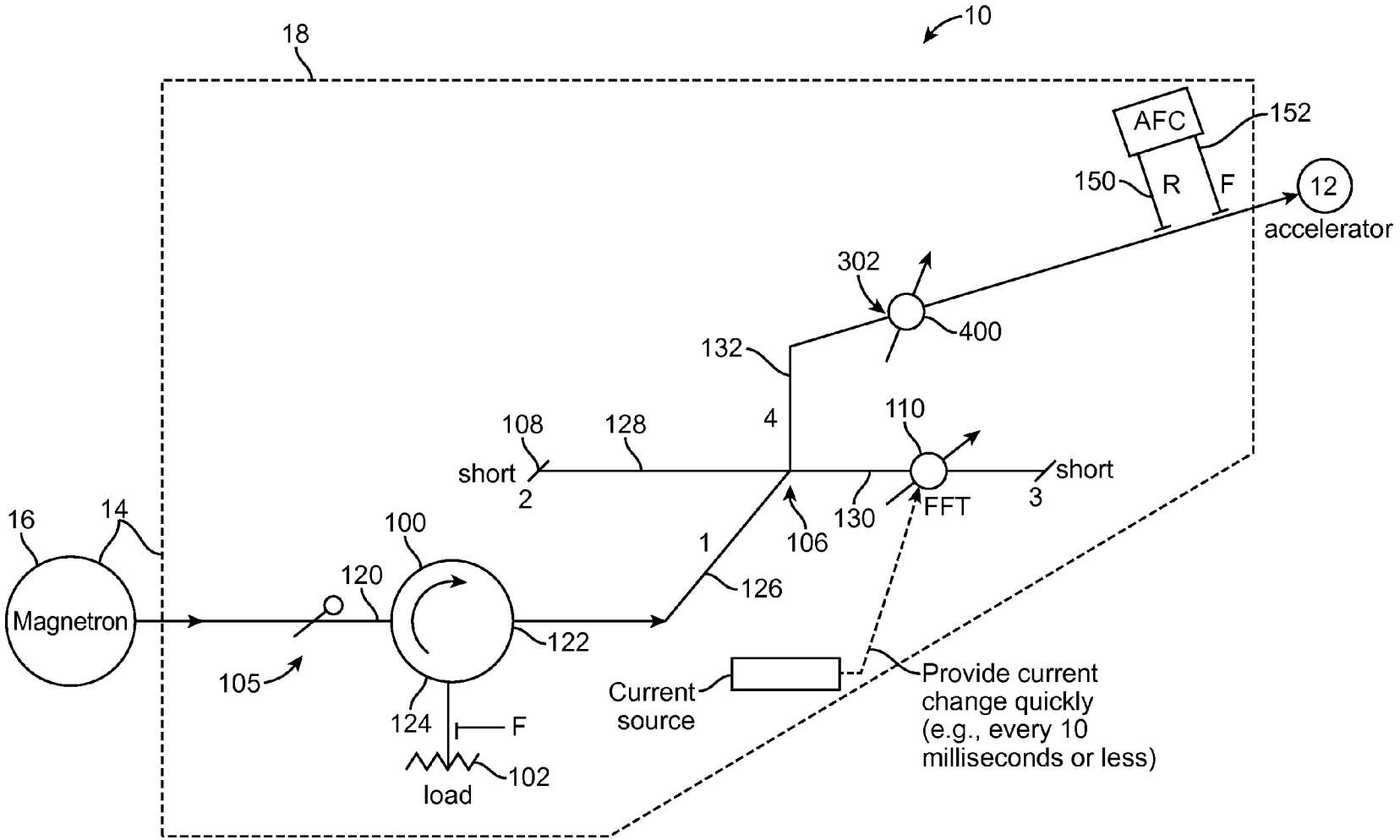
FIG. 4 illustrates a block diagram showing a variation of the power variator of FIG. 1 in accordance with other embodiments.

In FIG. 4, the second circulator 304 is omitted and a phase shifter 302 is included to provide control on the standing-wave in the output line 132 of the magic-tee 106. This phase-shifter 302 may be a variable phase shifter. For example, the variable phase shifter 302 can be a mechanical phase shifter, such as a ceramic element sized to be inserted into an electric field region. The variable phase shifter 302 can also be implemented using other mechanical and/or electrical components known in the art in other embodiments. In some embodiments, the variable phase shifter 302 includes a control, such as a knob, that allows a user to adjust the relative phase-shift imparted to the incident microwave through the phase shifter 302. In any of the embodiments described herein, the phase shifter 302 may be connected to a computer or a processor, which controls an operation of the variable phase shifter 302.

Presence of the standing-wave in the implementation seen in FIG. 1 and FIG. 4 may complicate the AFC signal processing as then the pickups 150, 152 include components from both the guide-reflection and the original incident wave. In practice, in interleaved operation, processing of the AFC error signal may proceed unhindered based on the HI mode trigger. In general post-processing of the F and R signals must account for the state of the tuner as this affects the output of the phase-comparison.

In the illustrated embodiments, the power from line 132 travels to phase-shifter 302. The phase-shifter 302 can be employed to provide additional control over the standing-wave between the tee 106 and the accelerator 12.

It should be noted that the power variator 18 is not limited to the example discussed previously, and that the power variator 18 can have other configurations in other embodiments. For example, in other embodiments, the power variator 18 needs not have all of the elements shown in the above embodiments. Also, in other embodiments, two or more of the elements may be combined, or implemented as a single component. In further embodiments, the power variator 18 may be used for other types of particle accelerators, such as proton accelerators. Further, the power variator 18 is not limited to use in the cargo inspection field, and may be used in other areas as well. For example, the power variator 18 may be used in the medical field, in which case, the accelerator 12 may be a part of a treatment and/or diagnostic device. For example, radiation treatment and/or imaging using particle accelerator (e.g., proton accelerator, electron accelerator, etc.) in which it is desirable to achieve two or more energies quickly and reliably may benefit from use of the power variator 18. In addition, in other embodiments, the method of controlling the power for the accelerator 12 described herein may be performed in conjunction with pulse-to-pulse manipulation of gun injection conditions, gun voltage, and/or gun grid pulse (if a gridded gun is used), which may assist in the regulation of the power for the accelerator 12.

Although particular embodiments have been shown and described, it will be understood that they are not intended to limit the present inventions, and it will be obvious to those skilled in the art that various changes and modifications may be made without departing from the spirit and scope of the present inventions. The specification and drawings are, accordingly, to be regarded in an illustrative rather than restrictive sense. The present inventions are intended to cover alternatives, modifications, and equivalents, which may be included within the spirit and scope of the present inventions as defined by the claims.

What is claimed:

1. An apparatus for regulating power for a particle accelerator, comprising:

a first circulator having a first port, a second port, and a third port, wherein the first port is configured for coupling to a power source; a tee having a first port, a second port, a third port, and a fourth port, wherein the first port of the tee is coupled to the second port of the first circulator, and the fourth port of the tee is configured for coupling to the particle accelerator;

a first short coupled to the second port of the tee;

a second short coupled to the third port of the tee;

a tuner coupled to the third port of the tee; and a first load coupled to the third port of the first circulator.

2. The apparatus of claim 1, wherein the tuner is a fast ferrite tuner.

3. The apparatus of claim 1, further comprising a phase-wand coupled between the first load and the first circulator.

4. The apparatus of claim 1, further comprising a second circulator having a first port that is coupled to the second port of the tee.

5. The apparatus of claim 4, wherein the second circulator has a second port for coupling to the accelerator, and a third port, and wherein the apparatus further comprises a second load coupled to the third port of the second circulator.

6. The apparatus of claim 1, further comprising:

the accelerator; and a phase-shifter coupled between the tee and the accelerator.

7. The apparatus of claim 1, further comprising an automatic frequency controller for controlling the power source based on a sensed power.

8. The apparatus of claim 1, further comprising the accelerator, wherein the fourth port of the tee is coupled to the accelerator, and wherein the accelerator is a part of a medical device.

9. An apparatus for use in a process to regulate power for a particle accelerator, comprising:

a tee having a first port, a second port, a third port, and a fourth port, wherein the first port of the tee is for receiving a power input, and the fourth port of the tee is configured for outputting power;

a first short coupled to the second port of the tee;

a second short coupled to the third port of the tee; and a tuner coupled to the third port of the tee, wherein the tuner comprises a ferrite material.

10. The apparatus of claim 9, wherein the tuner is configured to be biased magnetically.

11. The apparatus of claim 10, wherein the tuner is configured to be biased magnetically using a current.

12. The apparatus of claim 9, further comprising a current source for providing a current for varying a permeability of the ferrite material.

13. The apparatus of claim 9, wherein the tuner is configured to provide a phase change at every 10 millisecond or less.

14. The apparatus of claim 13, wherein the tuner is configured to provide the phase change using a current.

15. The apparatus of claim 9, further comprising the accelerator, wherein the fourth port is coupled to the accelerator, and wherein the accelerator is a part of a medical device.

16. The apparatus of claim 9, further comprising a phase-shifter for receiving power from the fourth port.

17. The apparatus of claim 9, further comprising a circulator for receiving power from the fourth port.

18. The apparatus of claim 17, wherein the circulator comprises three ports.

19. The apparatus of claim 9, further comprising an automatic frequency controller for controlling a power source based on a sensed power that is being transmitted to or from the accelerator.

20. An apparatus for regulating power for a particle accelerator, comprising:

a first circulator having a first port, a second port, and a third port, wherein the first port is configured for coupling to a power source;

a 3-dB coupler coupled to the second port of the first circulator, wherein the 3-dB coupler is configured for coupling to the particle accelerator;

a first short;

a second short;

a tuner; and a first load coupled to the third port of the first circulator; wherein the first short, the second short, and the tuner is coupled to the 3-dB coupler.

21. The apparatus of claim 20, wherein the tuner is a fast ferrite tuner.

22. The apparatus of claim 20, further comprising a phase-wand coupled between the first load and the first circulator.

23. The apparatus of claim 20, further comprising a second circulator having a first port that is coupled to the 3-dB coupler.

24. The apparatus of claim 23, wherein the second circulator has a second port for coupling to the accelerator, and a third port, and wherein the apparatus further comprises a second load coupled to the third port of the second circulator.

25. The apparatus of claim 20, further comprising:

the accelerator; and a phase-shifter coupled between the 3-dB coupler and the accelerator.

26. The apparatus of claim 20, further comprising the accelerator, wherein the 3-dB coupler is coupled to the accelerator, and wherein the accelerator is a part of a medical device.

27. An apparatus for use in a process to regulate power for a particle accelerator, comprising:

a first circulator configured to receive a microwave signal;

a second circulator;

a tee coupled between the first and the second circulator; and a tuner coupled to the tee.

28. The apparatus of claim 27, wherein the first circulator is configured to receive the microwave signal from a power source.

29. The apparatus of claim 27, wherein the second circulator is configured to couple to the accelerator.

30. The apparatus of claim 27, wherein the tuner comprises a ferrite material.

31. The apparatus of claim 30, wherein the tuner is configured to be biased magnetically.

32. The apparatus of claim 30, further comprising a current source for providing a current for varying a permeability of the ferrite material.

33. The apparatus of claim 27, wherein the tuner is configured to provide a phase change by changing a current at every 10 millisecond or less.

34. An apparatus for use in a process to regulate power for a particle accelerator, comprising:

a first circulator configured to receive a microwave signal;

a second circulator;

a 3-dB coupler coupled between the first and the second circulator; and a tuner coupled to the 3-dB coupler.

35. The apparatus of claim 34, wherein the tuner is configured to provide a phase change by changing a current at every 10 millisecond or less.

36. The apparatus of claim 34, wherein the first circulator is configured to receive the microwave signal from a power source.

37. The apparatus of claim 34, wherein the second circulator is configured to couple to the accelerator.

38. The apparatus of claim 34, wherein the tuner comprises a ferrite material.

39. The apparatus of claim 38, wherein the tuner is configured to be biased magnetically.

40. The apparatus of claim 38, further comprising a current source for providing a current for varying a permeability of the ferrite material.

* * * * *